United States Patent [19]

Roubin

[11] Patent Number: 4,647,091

[45] Date of Patent: Mar. 3, 1987

[54] MEDICINE CABINET LOCK

[76] Inventor: Richard Roubin, 3910 Prosperity Ave., Fairfax, Va. 22031

[21] Appl. No.: 822,151

[22] Filed: Jan. 24, 1986

[51] Int. Cl.[4] ..... E05C 3/14

[52] U.S. Cl. ..... 292/204; 292/DIG. 53; 292/DIG. 65

[58] Field of Search ..... 292/70, 76, 204, 209, 292/103, 107, DIG. 53, DIG. 46, DIG. 65, 121, 128; 49/449, 366

[56] References Cited

U.S. PATENT DOCUMENTS

| | | | |
|---|---|---|---|
| 824,417 | 6/1906 | Engebretson | 292/121 |
| 3,023,601 | 3/1962 | Luikart, II et al. | 292/DIG. 65 X |
| 3,608,341 | 9/1971 | Galtz | 70/95 |
| 3,797,871 | 3/1974 | Morishita | 292/DIG. 65 X |
| 3,827,184 | 8/1974 | Pennec et al. | 292/DIG. 5 X |
| 3,851,941 | 12/1974 | Stebe | 312/333 |
| 3,885,844 | 5/1975 | Schneider | 312/227 |
| 4,068,872 | 1/1978 | Smith | 292/87 |
| 4,270,668 | 6/1981 | Berfield | 292/103 X |

FOREIGN PATENT DOCUMENTS

| | | | |
|---|---|---|---|
| 808504 | 2/1959 | United Kingdom | 292/70 |

*Primary Examiner*—Richard E. Moore

*Attorney, Agent, or Firm*—H. Jay Spiegel

[57] ABSTRACT

The present invention relates to a locking mechanism which has particular application to a medicine cabinet. The device includes a first member which is adapted to be connected to the pivoting door of a medicine cabinet and a second member which is adapted to be connected to a side wall of the medicine cabinet receptacle portion itself. The member attached to the medicine cabinet receptacle wall includes a latching mechanism actuated with a pivoting movement to enable the latching and unlatching of the first mentioned member and thereby the locking and unlocking of the door of the medicine cabinet. The inventive locking mechanism may easily be utilized in other applications where it is desired to selectively lock a door.

9 Claims, 3 Drawing Figures

Fig. 1
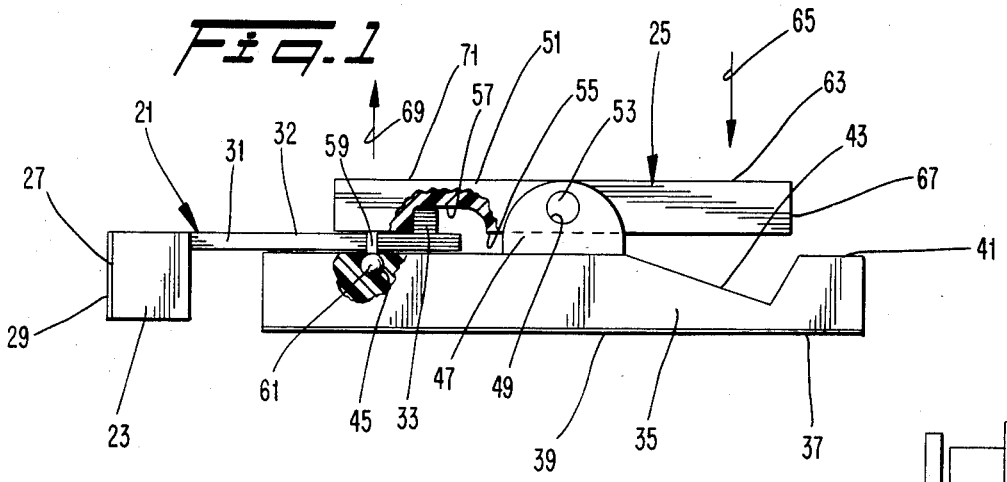
Fig. 2
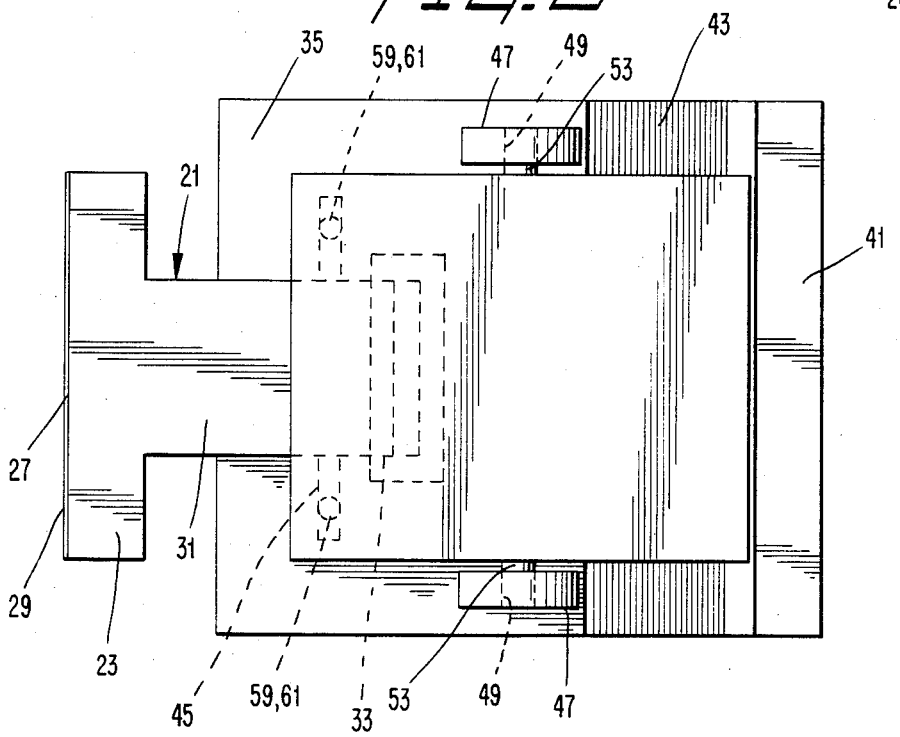
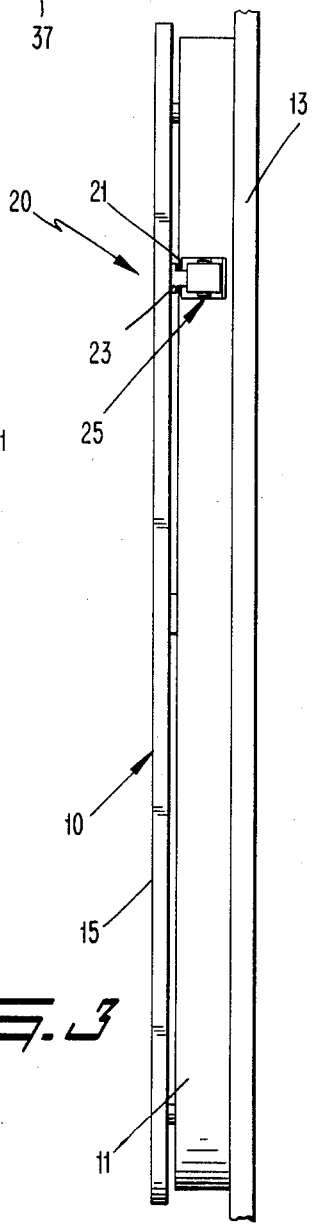
Fig. 3

MEDICINE CABINET LOCK

BACKGROUND OF THE INVENTION

The present invention relates to an improved medicine cabinet locking mechanism. In the prior art, a demand has existed for a long period of time for a locking mechanism which will render a medicine cabinet safe in the presence of small children. It is well known that small children have inquisitive minds and tend to investigate any device, receptacle, etc. Thus, children often investigate bottles and other objects contained within a medicine cabinet with disasterous results.

Solutions to this problem have been proposed in the prior art, however, they are not believed to be feasible since they include the provision of heavy latching devices which are not only cumbersome and expensive but are also esthetically unpleasing. Thus, a need has developed for a locking mechanism with particular applicability to a medicine cabinet which maintains the esthetic aspects of a medicine cabinet by being substantially concealed in use.

SUMMARY OF THE INVENTION

It was with the problems delineated hereinabove in mind that the present invention was developed.

The present invention solves the problems evident in the prior art by providing a simple and inexpensive locking mechanism which may be attached to any device including a pivoting door to enable the door to be selectively locked. In particular, when such a locking mechanism is applied to a medicine cabinet, it may easily be designed to be substantially invisible to the users thereof since it may be located in a concealed location behind overhanging edges of the door. The present invention includes the following interrelated features:

(a) The inventive locking mechanism includes a first member comprising a latch which is adapted to be connected to the pivoting door of the medicine cabinet. It may be attached thereto by any suitable means such as screws, bolts or, preferably, adhesive.

(b) The device further includes a second member consisting of an actuator and lock. The actuator, in the preferred embodiment, consists of a pivoting elongated member and the lock comprises at least one elongated member which may be pivoted by the actuator into a position wherein it retains the latch in a fixed position.

(c) The actuator is pivotally mounted on a base member having, in the preferred embodiment, an elongated recess which may releasably receive the above-described lock. The base member may be attached to a suitable location on the medicine cabinet such as a side wall thereof by any desired means such as screws, bolts or, preferably, through the use of adhesives.

(d) In another aspect, the actuator includes a recess in its underside which when the lock is engaged in the recess of the base member retains therein a detent protruding from the latch to thereby lock the door securely. In order to release the door, the actuator is pivoted until the lock and actuator recess free the latch and allow it to move along with the pivoting motion of the door.

Accordingly, it is a first object of the present invention to provide an improved medicine cabinet locking mechanism.

It is a further object of the present invention to provide such a medicine cabinet locking mechanism with an easily actuated lock which effectively retains a latch in a fixed position when so desired.

It is a still further object of the present invention to provide such a locking mechanism which is easily installed and easily operated.

It is a still further object of the present invention to provide such a device which may be manufactured from inexpensive materials.

These and other objects, aspects and features of the present invention will be better understood from the following detailed description of the preferred embodiment when read in conjunction with the appended drawing figures.

BRIEF DESCRIPTION OF THE DRAWINGS

FIG. 1 shows a side view of the present invention.

FIG. 2 shows a top view of the present invention.

FIG. 3 shows a view similar to FIG. 2 but with the invention as installed on a cabinet having a pivoting door.

SPECIFIC DESCRIPTION OF THE PREFERRED EMBODIMENTS

Reference is first made to FIG. 3 which shows a cabinet 10 having a receptacle 11 attached to the wall 13 and a door 15 pivotable with respect thereto on hinges (not shown) between the shown closed position and an open position enabling access to the receptacle.

As shown in FIG. 3, the present invention is designated by the reference numeral 20 and is seen to include a latch 21 including a leg 23 and an actuator and lock mechanism 25. With reference now to FIGS. 1 and 2, it is seen that the leg 23 of the latch 21 includes a bottom surface 27 which may include means such as adhesive 29 to adhere the leg 23 and thereby the latch 21 to an inside surface of the door 15 shown in FIG. 3. Of course, alternatively, the adhesive 20 may be replaced by screws, bolts or the like, although the adhesive 29 is preferred due to its simplicity. In fact, in the preferred embodiment, it is preferred that the adhesive 29 be covered by a removable paper which protects the adhesive before it is to be used.

With further reference to FIGS. 1 and 2, it is seen that the latch 21 includes an elongated leg 31 substantially perpendicular to leg 23 with the leg 31 having protruding therefrom an upstanding detent 33 which extends across the entire width of the leg 31 as best seen in FIG. 2. The detent 33 is provided for the purpose to be explained in greater detail hereinafter.

With further reference to FIGS. 1 and 2, it is seen that the actuator and lock 25 includes a base member 35 having a bottom surface 37 preferably covered by adhesive 39 similar to the adhesive 29 and preferably initially having a paper covering the adhesive 39 until such time as the device 20 is ready for installation. The base 35 further includes a top surface 41 having a first angular recess 43 for a purpose to be described hereinafter and a second recess 45, also for a purpose to be described hereinafter.

Upwardly extending from the surface 41 are a pair of ears 47 each of which has a hole 49 therethrough also for a purpose to be described in greater detail hereinafter.

The actuator and lock 25 further includes an actuator 51 comprising an elongated member having a pair of opposed pins 53 arranged to fit into the holes 49 of the ears so as to render the actuator 51 pivotable with respect to the base 35. As best seen in FIG. 1, the actuator 51 includes an undersurface 55 having extending inwardly therefrom a recess 57 for a purpose to be described hereinafter. Further, extending outwardly from this undersurface 55 is locking means comprising, in the preferred embodiment, two elongated stems 59 each of which has an enlarged portion at the end thereof comprising, in the preferred embodiment, a substantially spherical ball 61.

As best seen in FIG. 1, the balls 61 are so sized that they fit into the elongated recess 45 with a snap fit which frictionally retains the balls 61 therein until a predetermined force is applied on the actuator 51 at the region 63 and in the direction of the arrow 65. As further seen in FIG. 1, the recess 43 in the base 35 is provided so as to enable pivoting of the actuator 51 in the direction of the arrow 65 and when the actuator 51 is so pivoted, the end 67 thereof enters the recess 43 while the stem 59 and ball 61 move upwardly in the direction of the arrow 69. When such movement takes place, due to the application of a force above the predetermined force in the direction of the arrow 65 and at the region 63, such force is sufficient to overcome the retention power of the recess 45 of the base 35 and the balls 61 may be released from the recess 45 so as to enable the actuator 51 to pivot in the direction of arrows 65 and 69.

When the actuator 51 is in the position shown in FIG. 1, the detent 33 of the leg 31 of the latch 21 is captured within the recess 57 of the actuator 51 to thereby prevent movement of the latch 21 and thereby to prevent movement of the associated door 15 (FIG. 3). As best seen in FIG. 2, the stems 59 are sufficiently spaced apart so that they straddle the lateral side of the latch 21 leg 31 with the underside 55 of the actuator 51 closely overlying the top surface 32 of the leg 31 of the latch 21.

Thus, it may be understood, that when the actuator 51 is in the position shown in FIG. 1, the latch 21 via the interaction of the detent 33 and recess 57 is securely retained in a fixed position with respect to the actuator and lock 25 and no movement of the door 15 is possible. Conversely, when it is desired to open the door 15, one must only press the actuator 51 at the region 63 in the direction of the arrow 65 with sufficient force so that the balls 61 pop out of the elongated recess 45 and thereby allow pivoting of the actuator 51 until the detent 33 is no longer captured within the recess 57 in the underside 55 of the actuator 51. In such position of the actuator 15, the door 51 may be freely pivoted to an open position.

When it is desired to lock the cabinet, with the latch 21 disengaged from the actuator and lock 25 the actuator 51 is pivoted by pressing at the region 63 in the direction of the arrow 65 to lift the recess 57 sufficiently so that the detent 33 may pass under the underside 55 of the actuator 51. Then, the door 15 may be swung until the detent 33 is aligned under the recess 57 of the actuator 51 whereupon the actuator 51 may be pressed at the region 71 with sufficient force to engage the balls 61 in the recess 45 to thereby lock the actuator and lock 25 about the latch 21.

In the preferred embodiment of the present invention, all of the various components thereof may be injection molded. It is preferred that the components of the present invention be made of plastic materials such as, for example, polypropylene, nylon, high percentage fiberglass polypropylene and the like.

It is further stressed that although the present invention has been depicted in conjunction with installation as a medicine cabinet lock, it must be stressed that the present invention is usable as a locking mechanism in any situation where it is desired to maintain a closure selectively locked. Thus, the present invention may easily be adapted through minor modifications to use in locking a dresser drawer, a china cabinet door, or any other closure mechanism.

Various modifications, alterations and changes in the teachings of the present invention may be contemplated by those skilled in the art without departing from the intended spirit and scope of the present invention. Accordingly, it is stressed that it is intended that the present invention only be limited by the terms of the appended claims.

I claim:

1. An improved locking mechanism comprising:

(a) a latch connectable to a closure;

(b) a lock including a pivoting actuator pivotable about a pivot axis, a recess in said actuator, and an elongated locking member extending outwardly from said actuator in a direction approximately perpendicular to said pivot axis;

(c) a base pivotably carrying said lock, said base including a locking recess interengageable with said locking member, said base being connectable to a stationary surface;

(d) said latch having an upstanding detent sized to be capturable in said actuator recess;

(e) whereby with said latch connected to said closure and said base connected to said stationary surface, said actuator may be pivoted to a first position allowing movement of said latch to a position aligning said detent with said actuator recess, whereupon said actuator may be pivoted to a second position capturing said detent in said recess and locking said locking member in said locking recess, said detent, in said second position, being located between said locking member and said pivot axis.

2. The invention of claim 1, mounted on a cabinet with a closure, wherein said closure comprises a pivoting door of said cabinet and said base being connected to a stationary surface comprising a wall of said cabinet.

3. The invention of claim 2, wherein said latch is adhesively connected to said closure.

4. The invention of claim 1, wherein said locking member includes an enlarged end member.

5. The invention of claim 4, wherein said end member fits in said locking recess with a snap fit.

6. The invention of claim 1, wherein said improved locking mechanism is made of plastic.

7. The invention of claim 1, wherein said locking member comprises a plurality of elongated locking devices each of which is releasably retained in said locking recess.

8. The invention of claim 2, wherein said base is adhesively connected to said stationary surface.

9. The invention of claim 1, wherein said latch includes a first leg connectable to said closure and a second leg carrying said detent.

* * * * *